US008517621B2

(12) United States Patent
Ornoski et al.

(10) Patent No.: US 8,517,621 B2
(45) Date of Patent: Aug. 27, 2013

(54) COSMETIC CAP SEALING SYSTEM

(75) Inventors: Gregory A. Ornoski, Teaneck, NJ (US); Marisol Simard, Upper Nyack, NY (US)

(73) Assignee: Avon Products, Inc., New York, NY (US)

( * ) Notice: Subject to any disclaimer, the term of this patent is extended or adjusted under 35 U.S.C. 154(b) by 0 days.

(21) Appl. No.: 13/279,392

(22) Filed: Oct. 24, 2011

(65) Prior Publication Data

US 2013/0101333 A1 Apr. 25, 2013

(51) Int. Cl.
*A46B 11/00* (2006.01)
*A46B 17/08* (2006.01)

(52) U.S. Cl.
USPC ..... 401/4; 401/121; 401/122; 401/129

(58) Field of Classification Search
USPC ..... 401/4, 118, 121, 122, 126, 129
See application file for complete search history.

(56) References Cited

U.S. PATENT DOCUMENTS

| | | | | |
|---|---|---|---|---|
| 3,311,941 | A * | 4/1967 | Baker et al. | 401/4 |
| 4,403,624 | A | 9/1983 | Montgomery | |
| 5,061,103 | A | 10/1991 | Walsh-Smith | |
| 5,074,693 | A * | 12/1991 | Iizuka et al. | 401/4 |
| 5,172,992 | A | 12/1992 | Ackermann | |
| 5,192,153 | A * | 3/1993 | Gueret | 401/4 |
| 5,700,100 | A | 12/1997 | Ackermann | |
| 6,773,186 | B1 * | 8/2004 | Shih | 401/129 |
| RE38,698 | E * | 2/2005 | Joulia | 401/4 |
| 7,223,035 | B1 | 5/2007 | Engel et al. | |
| 8,403,580 | B2 * | 3/2013 | De Laforcade | 401/129 |
| 2003/0053844 | A1 * | 3/2003 | Lebras Brown et al. | 401/130 |
| 2005/0232681 | A1 * | 10/2005 | Gueret | 401/129 |

* cited by examiner

*Primary Examiner* — David Walczak
*Assistant Examiner* — Bradley Oliver
(74) *Attorney, Agent, or Firm* — David M Joyal; Joan M. McGillycuddy

(57) ABSTRACT

Packages are provided including an applicator that engages with a wiper of a container in a manner such that the applicator and wiper are capable of rotating together in relation to the container. The package also includes a cap configured to fit over the applicator when the applicator is engaged with the wiper element. The cap is engaged with the wiper such that the wiper is caused to rotate when the cap is rotated, screwed onto, and/or unscrewed from, the container, thereby moving the applicator element in a rotational motion in the interior of the container.

15 Claims, 10 Drawing Sheets

FIG. 1
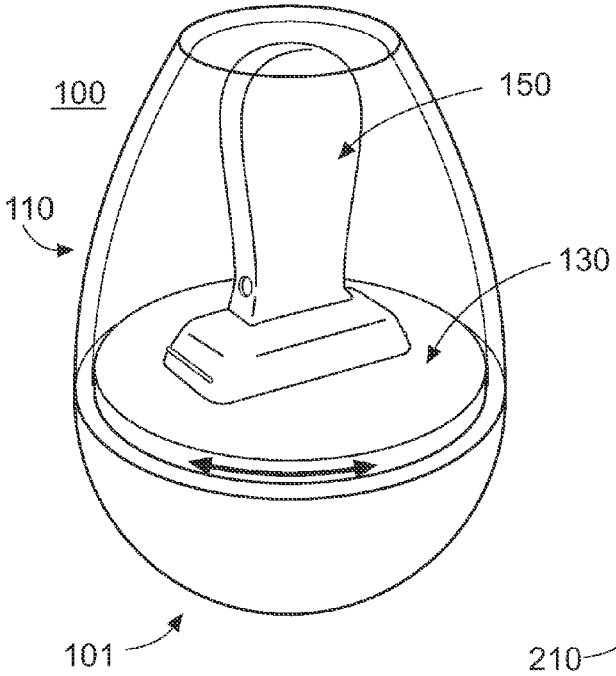
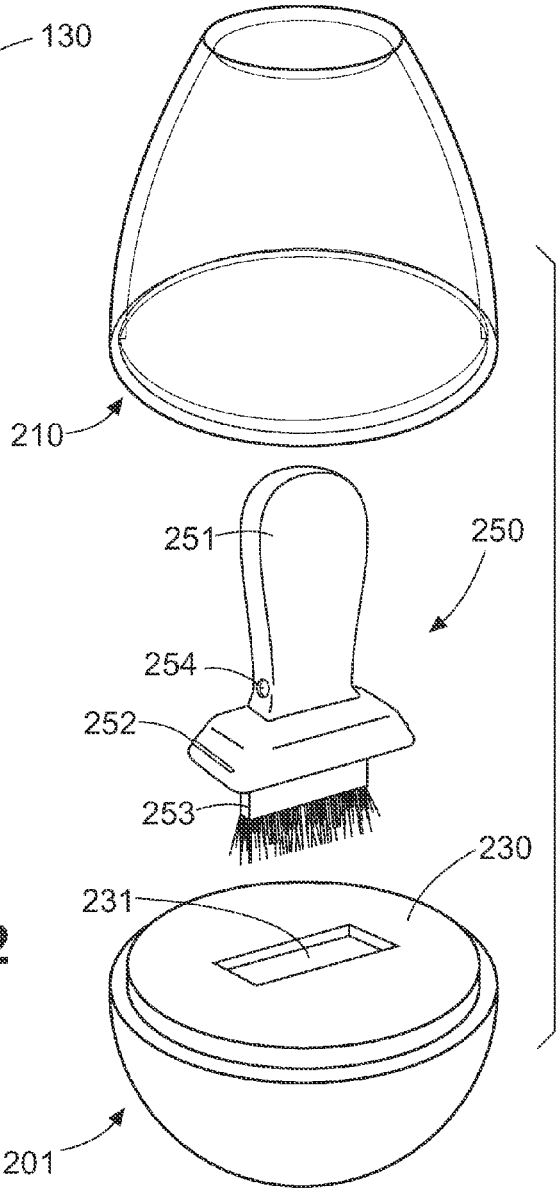
FIG. 2

COSMETIC CAP SEALING SYSTEM

FIELD OF THE INVENTION

The present application generally relates to packaging for cosmetic products, such as mascara, which comprises a container for holding a cosmetic composition and an applicator which is disposed through an opening in the container such that a portion of the applicator is brought into contact with the cosmetic composition. As the applicator is removed from the container, a wiper removes excess cosmetic composition from the applicator. The wiper of the present invention is dynamic rather than static with respect to the container and is adapted to rotate upon opening, closing, and/or rotating the cap of the container.

BACKGROUND

Conventional mascara packaging consists of a cylindrical container that contains a supply of mascara, the container having a threaded neck to which a cap and rod applicator assembly is reversibly secured by complementary threading on the cap. The rod is inserted into the container through a wiper prior to closing the cap and, as the user screws the cap onto the container, the rod only moves a short distance (i.e., the height of the threaded area) further into the container. When the user unscrews the cap and withdraws the rod, the wiper scrapes or removes excess cosmetic from the applicator element to provide a more uniform, metered dose of mascara on the applicator. The wiper conventionally consists of an annular construction of rubber or plastic in or near the neck of the container. Such mascara applicators and packaging are disclosed, for example, in U.S. Pat. No. 4,403,624 to Montgomery and U.S. Pat. No. 5,061,103 to Walsh-Smith, to name just a few.

A drawback to the conventional design is that the rod is axially centered in the container through a static wiper. Unfortunately, due to the thixotropic property of cosmetic products, the user must manually agitate the product prior to application, such as by shaking the cosmetic package. Consequently, much of the product that is inaccessible to the applicator element is wasted and may wind up hardening inside the container.

One attempt to solve this problem is disclosed in U.S. Pat. Nos. 5,700,100 and 5,172,992, both to Ackermann, which relate to a mascara packaging having a stirring element that removes mascara from the edges of the container when the cap is screwed on or off. Likewise, U.S. Pat. No. 5,074,693 to Iizuka et al. also describes a stirrer in conjunction with a mascara application for the purpose of scraping viscous cosmetic liquids from the inner surface of the container.

Another approach for bringing more of the liquid cosmetic disposed in the container into contact with the applicator has involved the provision of a flexible container which may be squeezed by the user to force the composition on to the applicator. Such a device is described in U.S. Pat. No. 7,223,035 to Engel et al.

There is a continuing need in the art for improved functional designs for cosmetic applicators which overcome one or more of the deficiencies of the conventional applicators. It is therefore an object of the invention to provide cosmetic packages which provide for dynamic movement of the applicator within the interior of the container. In particular, it is an object of the invention to provide a dynamic wiper which, when engaged with the applicator, permits the applicator element to be moved within the interior of the container when the cap of the container is screwed onto, unscrewed from, and/or rotated about the container.

SUMMARY OF THE INVENTION

In accordance with the foregoing objectives and others, the present invention provides packages for cosmetics having an applicator which engages with a dynamic wiper component in a manner such that the applicator and wiper are capable of rotating within the container when a cap of the package is rotated about the container, such as when the cap is screwed or unscrewed from the container. The rotational capabilities of the wiper permits an applicator element to agitate the composition and to provide a more uniform coating of the composition on the applicator element, thereby allowing for an enhanced user experience.

The invention provides a new package for a composition (e.g., a mascara or other cosmetic). The package includes a container for holding the composition. The package also includes a wiper that is capable of rotating with respect to the container, which has an orifice forming a passage between the exterior and interior of the container. Additionally, the package includes an applicator for removing a portion of the composition from the container and transferring it to a surface. The applicator includes a handle for gripping on one end thereof and an applicator element for holding a charge of the composition on the other end thereof. The applicator is disposed through the wiper orifice such that a portion of the applicator element is brought into contact with the composition. Accordingly, the orifice of the wiper is generally complementary in shape to the cross-sectional shape of the applicator element so that it can scrape or remove excess composition from the applicator element when the applicator element is drawn through the orifice upon removal of the applicator from the container. The package also includes a cap configured to fit over the applicator when the applicator is engaged with the wiper. The wiper is caused to rotate when the cap is rotated about the container, such as when the cap is screwed and/or unscrewed from the container, thereby moving the applicator element in a rotational motion in the interior of the container.

In certain embodiments, the cap may include threading complimentary to threading of the container such that the cap may be reversibly screwed onto the container. In other embodiments, the cap may simply engage with the container via a snap fit or the like. In yet other embodiments, the cap and container may comprise both complimentary snap fits and complimentary threading.

For example, a package is provided including a wiper disposed on a top surface of a container, partially within the interior of a container, or completely within the interior of the container. The wiper has a top surface in the shape of a generally annular disk defining an orifice therethrough. The top surface includes a plurality of alternating grooves and projections radially disposed around its circumference. The package also includes a cap that includes, on the interior thereof, a plurality of grooves and projections complementary to those of the wiper element. Accordingly, the projections of the cap engage with the grooves of the wiper and rotate the wiper as the cap is rotated about the container.

By virtue of the rotational movement of the applicator/wiper assembly, the applicator element is capable of stirring product within the interior of the container without spilling or splashing. This is particularly advantageous where the composition is pseudoplastic, having a high initial viscosity in the absence of shear, because the applicator element can recover composition adhered to the inner walls of the container which would otherwise be wasted or accessible only with vigorous shaking of the container. The dynamic wiper arrangement of the invention is also contemplated to find application with all types and configurations of applicator elements, for example with generally flat, planar, wedge, cylindrical, spherical, triangular, and other shaped applicator elements. In one case, the applicator element may have an oblong shaped cross-section and the wiper orifice will have a complementary oblong shape.

These and other aspects of the invention will be better understood by reading the following detailed description and appended claims.

BRIEF DESCRIPTION OF THE DRAWINGS

The preferred embodiments of the present invention are illustrated by way of example and are not limited to the following figures:

FIG. 1 illustrates an exemplary package having a dynamic wiper and cap sealing system;

FIG. 2 is an exploded view of an exemplary package;

DETAILED DESCRIPTION

Figure 3:
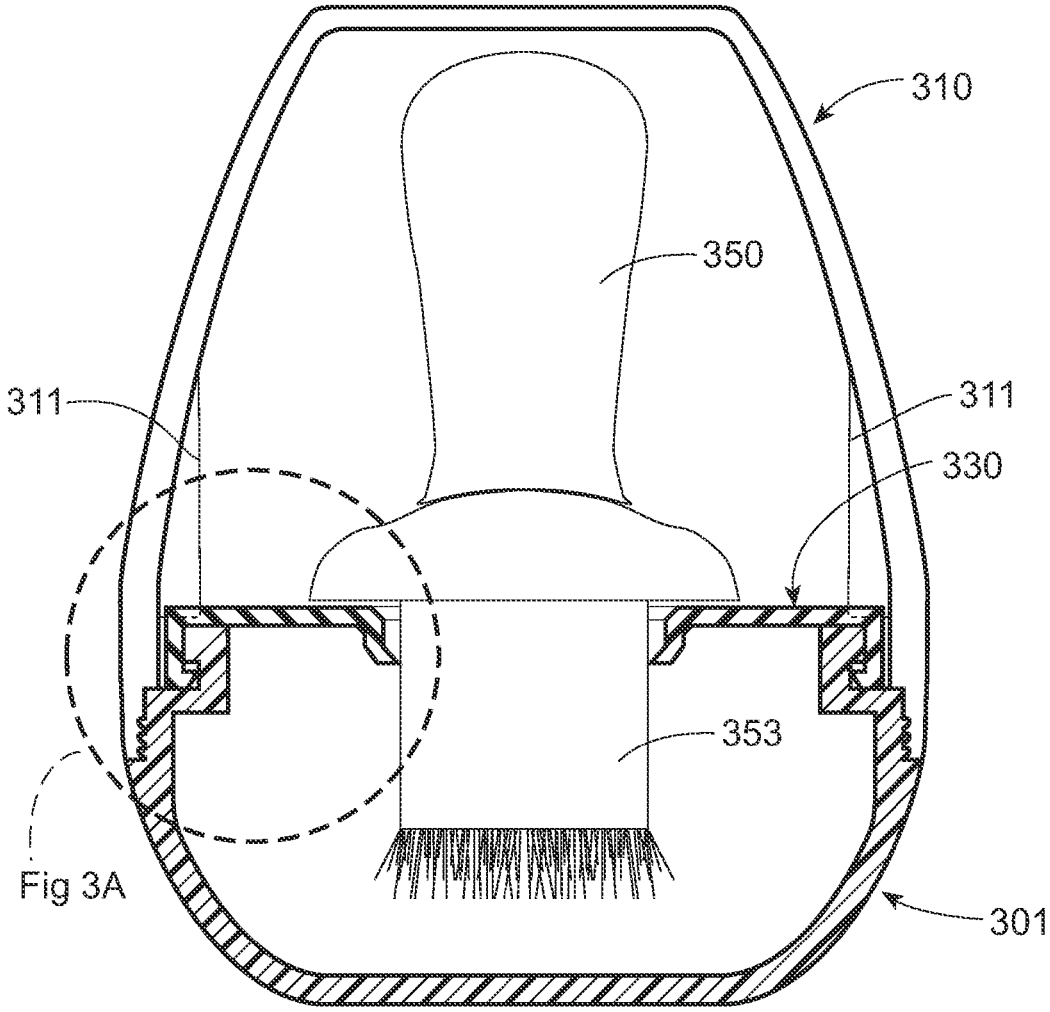
FIG. 3 is a cross-sectional view of an exemplary package having a dynamic wiper 330 disposed on a top surface of a container 301.

All terms used herein are intended to have their ordinary meaning in the art unless otherwise provided.

The materials to be dispensed are not particularly limited and include paints, cosmetics, and adhesives, to name a few, and may be in the form of solids (e.g., powders), suspensions, emulsions, liquids, and the like. As used herein, the term liquid is intended to include very viscous materials, including non-Newtonian liquids having very high initial viscosities, as well as gels and other materials capable of being dispensed from a container onto an applicator. Particular mention may be made of cosmetics, including, without limitation, mascara, foundation, lip gloss, lip colors, hair colors, hair styling formulations, nail polishes, and the like. The viscosity of the composition is not limited and may range, for example, from about 10 cps to about 1,000,000 cps. Without intending to be limited, it is believed that the advantages of the present invention will be most fully realized when the cosmetic formulations are pseudoplastic or thixotropic, or otherwise have high viscosities at room temperature (e.g., greater than about 10,000 cps) such that they tend to adhere to the container walls in the absence of shear forces. In one preferred embodiment, the product is in the form of a mascara for application to the eyelashes.

Referring to FIG. 1, an exemplary package 100 according to the invention is illustrated. A container 101 is shown comprising side walls extending from a closed base to an open mouth to define an interior space for holding a charge of a composition, such as a liquid or solid. The container 101 is made of any suitable material, for example, molded or blow-molded plastic, glass, metal, laminated material, or any combination thereof. Moreover, although the container 101 will typically be a solid structure, it may also be flexible in one or more dimensions. In one embodiment, the container comprises a bowl-shape.

The package 100 is shown in a closed state, wherein a cap 110 is sealably engaged with the container 101. Typically, the cap 110 is made from a solid material, such as plastic, metal, and/or glass. The cap 110 will generally comprise threading such that it may be reversibly screwed onto complementary threading of the container 101. However, in other embodiments, the cap 110 may additionally or alternatively comprise a snap fit such that it may be snapped onto a complimentary snap fit of the container 101. Moreover, the cap 110 is configured to fit over an applicator 150 when the applicator is seated within a dynamic wiper 130 of the package 100. In this way, the cap 110 may be reversibly attached to the container to prevent the applicator 150 from inadvertently being removed from the wiper 130. When a user desires to remove the applicator 150, the cap 110 is removed from the container 101 (i.e, unscrewed and/or pulled off) and the applicator is pulled from within the container.

The dynamic wiper 130 is disposed within or on top of the container 101 and prevents the product held in the container from escaping when the applicator 150 is positioned within the orifice in the wiper 130 (e.g., FIG. 2 at orifice 231). As discussed in detail below, the wiper 130 is in contact with the container 101 in such a way as to allow the wiper to freely rotate with respect to the container when a rotational force is applied to the wiper. For example, an applicator 150 may be seated within the dynamic wiper 130 and may be manipulated by a user to rotate both the applicator and wiper with respect to the container. The wiper 130 typically includes projections (e.g., grooves, teeth, indentations, raised structures, etc.) such that it may engage with a corresponding structure in the cap 110 when it is in contact with the container 101. In this way, the wiper 130 may be rotated with respect to the container 101 when the cap 110 is rotated about the container.

In one embodiment, the dynamic wiper 130 is freely rotatable about a vertical axis extending from the center of the base of the container 101 through the geometric center of the dynamic wiper 130 (e.g., the "central axis"). Accordingly, when the applicator 150 is seated in the dynamic wiper 130, it may be rotated about the central axis, while still preventing the product from exiting the orifice. Moreover, such rotation occurs without spinning the applicator 150 (i.e. without slippage between the applicator 150 and the dynamic wiper 130). Rather, the applicator 150 rotates about the central axis while engaged with the dynamic wiper 130. In this way, the applicator element may be rotated within the container 101 to stir the product contained therein, without allowing the product to splash or spill. In an alternative embodiment, the applicator 150 may be spinnable within the orifice of the wiper.

Referring to FIG. 2, an exploded view of an exemplary package comprising a cap 210, an applicator 250, a dynamic wiper 230, and a container 201 is shown. The applicator 250 comprises a handle 251 which may, for example, be specially adapted with impressions or textured surfaces for gripping with the fingers. The applicator 250 also comprises a base 252 extending from the handle 251 to an applicator element 253. The handle 251 and base 252 may be formed from a unitary piece or material or may be separate members that are connected. The base 252 may be connected to the handle 251 via, for example, a pivot hinge 254, which allows for tilting of the handle to a desired angle position. The pivot hinge 254 may be locked into place via various locking/unlocking mechanisms (not shown), such as but not limited to a push stop or multi-stage button.

The shape of the base 252 is not important and may be of circular cross-section, semi-circular cross-section, rectangular cross-section, oblong cross section, or the like. Moreover, the applicator element 253 may be of any material and configuration capable of holding a charge of material and transferring it to the desired surface, such as a human integument, including keratin fibers (hair of the scalp, eyelashes, etc.), nails, lips, skin, or the like. The applicator element 253 may, for instance, take the form of a molded brush, a twisted wire brush, a foam pad, a flocked surface, a staked fiber brush, a comb, a plastic spatula, or any other surface which can hold and deliver the material.

As shown, the dynamic wiper 230 comprises an annular disk having an orifice 231 through its geometric center such that the applicator element 253 may be passed therethrough to access product contained within the container. The orifice 231 corresponds to the size of the applicator element 253 and base 252 of the applicator 250, such that the applicator element may be inserted through the orifice to the inside of the container. Once the applicator element 253 is seated within the orifice 231, the dynamic wiper 230 and applicator 250 prevent any product contained within the container from exiting through the orifice. In one embodiment, the wiper and/or the orifice may comprise a snap fit or friction fit to removably anchor the applicator 250 within the orifice 231. Of course, the dimensions and size of the orifice 231 will vary depending on the geometry of the applicator 250. For example, the orifice 231 will typically be rectangular when the cross-sections of the applicator element 253 and base 252 are rectangular.

In one embodiment, the dynamic wiper 230 may comprise an orifice 231 therethrough, which is located away from its geometric center (i.e., "off-center" or "offset from the center"). When the orifice 231 is off-center, the dynamic wiper 230 and seated applicator 250 are freely rotatable about a central axis of the package, however, the off-center location of the orifice 231 allows for the applicator element 253 to access more of the product in the container, specifically product located on or about the inner side walls of the container.

Although the dynamic wiper 230 is shown as a rigid structure, in one embodiment, the wiper 230 may be adapted to allow an applicator 250 seated therein to move with the wiper in multiple directions, including without limitation, vertically, horizontally, diagonally, rotationally, and any combination of such movements, as described in U.S. patent application Ser. No. 13/259,518, titled "Functional Dynamic Cosmetic Package," filed contemporaneously herewith on Oct. 24, 2011, incorporated herein by reference in its entirety. For example, in one embodiment, the dynamic wiper may comprise a flexible material, which is typically an elastomer polymer such as synthetic or natural rubber. In another embodiment, the wiper 230 may comprise a telescoping surface to allow the wiper and applicator 250 to move in multiple directions, without slipping. Moreover, the telescoping surface of the wiper 230 may comprise either a flexible material or a rigid material, depending on the desired range of movement of the applicator element 253. In another embodiment, a plurality of interchangeable applicator elements 253 may be provided in a kit comprising the package described and claimed herein to provide the user greater flexibility in using the product.

Referring to FIG. 3, a cross-sectional view of an exemplary package is shown having a dynamic wiper 330 seated on top of a container 301. The package comprises an applicator 350 seated within the dynamic wiper 330 such that the applicator element 353 is in contact with a product contained within the container 301. The package also includes a cap 310 having fins 311 that come into contact with the wiper 330 when the cap is screwed onto the container 310.

Figure 3A:
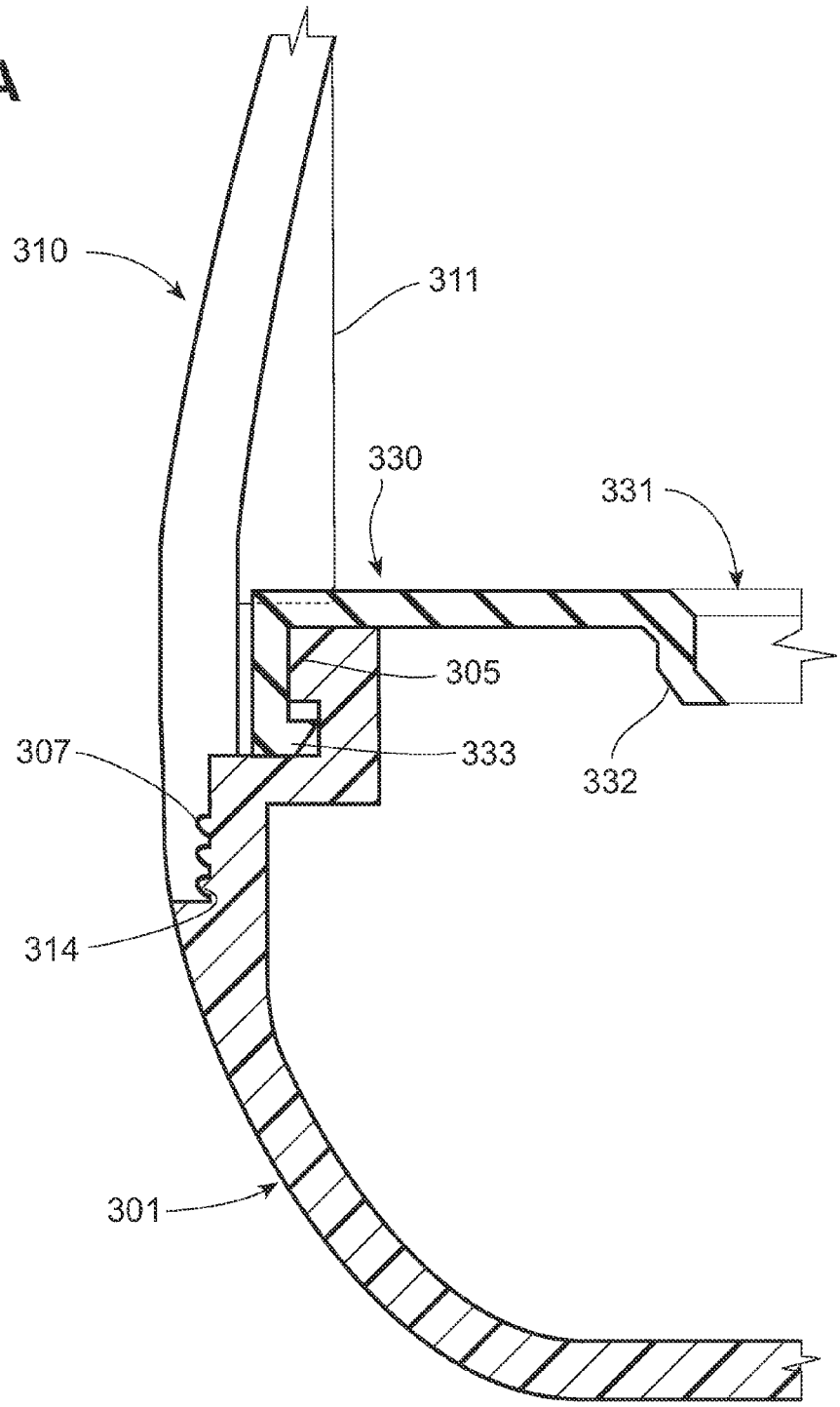
FIG. 3*a* is a close-up view of a connection between a dynamic wiper 330 and a container 301.

FIG. 3A shows a close-up view of an exemplary connection between the dynamic wiper 330 and the container 301. As shown, the dynamic wiper 330 comprises an inner lip 333 extending inward from a bottom (or near-bottom), inner surface thereof. The inner lip 333 allows the dynamic wiper 330 to be latched; joined, or otherwise attached to an outer surface a flange 305) of a container 301. Although the inner lip 333 typically comprise a continuous structure, it may alternatively comprise two or more projections extending from the bottom or near the bottom of the wiper 330 towards its interior.

In any event, the inner lip 333 acts to prevent the dynamic wiper 330 from falling of the top of the container when it is placed in contact with a flange 305 located on the outer surface of the container 301. The inner lip 333 of the wiper 330 and the flange 305 of the container 301 may be connected, joined, or placed into contact with one another such that, even when the inner lip 333 exerts a force on the flange 305, the dynamic wiper is prevented from falling off of the container.

In one embodiment, the connection between the inner lip 333 of the dynamic wiper and the flange 305 of the container 301 may form a type of slip joint such that independent motion of the dynamic wiper is allowed with respect to the container 301 (e.g., horizontal, vertical, and/or rotational movement). Stated another way, although the dynamic wiper 330 is prevented from being pulled or pushed off of the container 301, the connection between the wiper and the container is such that the wiper may move in a horizontal, vertical, and/or rotational direction with respect to a stationary container.

The package is shown in a closed state, having a cap 310 screwed onto the container 301. The cap 310 comprises threading 314 such that it may be reversibly screwed onto complementary threading 307 of the container 301. Importantly, when the cap 310 is completely screwed onto the container 301, fins 311 attached to the inner surface of the cap exert a downward force on the wiper 330, causing a seal between the wiper and the container. In lieu of fins 311, the cap 310 can use any suitable method for sealing the wiper and the container, e.g., an annular bead, discontinuous lands, ribs, and the like. Therefore, when the cap is screwed or otherwise sealingly connected onto the container, there may be a space or gap between the inner lip 333 of the wiper 330 and the flange 305 of the container. However, when the cap is removed from the container, any upward force on the wiper (e.g., pulling the applicator) will cause the inner tip 333 of the wiper to catch on the flange 305 of the container.

Figure 4:
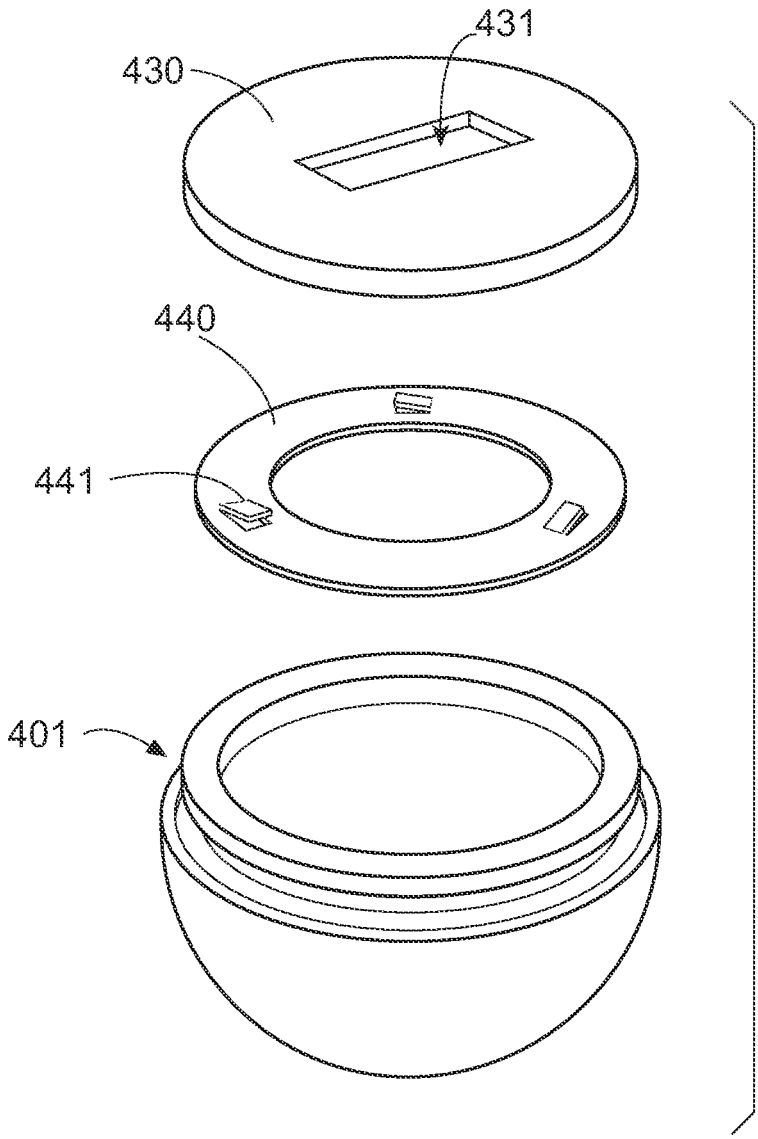
FIG. 4 is an exploded view of an exemplary package.

Referring to FIG. 4, an exploded view of an exemplary package comprising a dynamic wiper 430, a compression ring 440, and a container 401 is shown. In one embodiment, during assembly, a compression ring 440 may be inserted into an annular cavity of the dynamic wiper 430. Typically, the compression ring 440 is made from a solid material, such as plastic, metal, and/or glass, and is attached to the container 401 by any conventional means, such as but not limited to a sealant, complementary threading, snaps, or the like. The compression ring 440 is attached to the container 401 in such a way as to prevent leaking of the product at the point of attachment.

One or more compressible flaps 441 are formed on the top surface of the compression ring 440. In practice, the compressible flaps 441 are compressed by the bottom end of the wiper 430 when a cap (not shown) is screwed onto the container 401 or when a downward force is applied thereto. In this way, a seal is formed between the wiper 430, the compression ring 440, and the container 401, such that product may not exit the container. However, when the cap is removed from the container 401, the downward force is removed from the dynamic wiper 430, and it may again move with respect to the container.

According to one embodiment, the compressible flaps 441 are formed circumferentially along the perimeter of the compression ring 440, in another embodiment, the compressible flaps 441 are formed radially on selected spots on the ring 440. Although FIG. 4 shows only three compressible flaps 441 in a circumferential configuration, it will be appreciated that different shapes and sizes of compressible flaps 441 in any number of configurations may be employed. For example, the compressible flaps 441 may be formed on the bottom surface of compression ring 441) instead of the top surface as shown in FIG. 4 or may be formed on a surface of the wiper 430 or on the top surface of the container 401, rather than on a compression ring 440.

Figure 5:
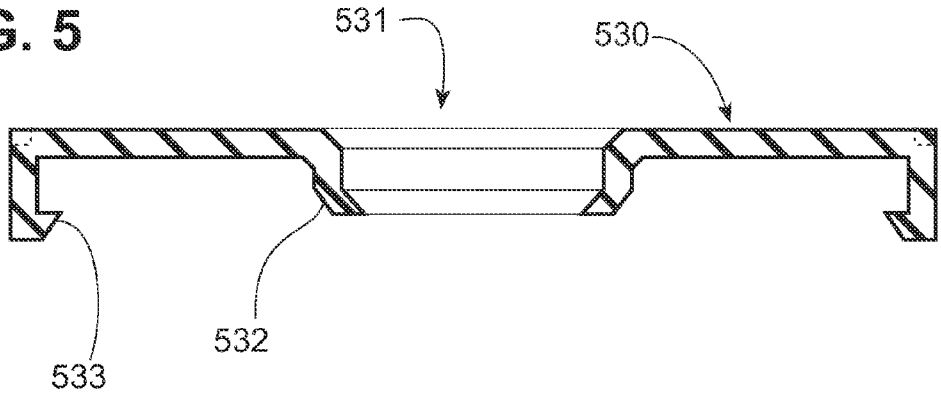
FIG. 5 is a cross-sectional view of an exemplary dynamic wiper 530 on a plane through an orifice 531 of the wiper.

Referring to FIG. 5, a cross-sectional view of a dynamic wiper 530 (such as the dynamic wiper 330 shown in FIG. 3) is shown as taken across a plane intersecting an orifice 531. The dynamic wiper is shown to comprise an inner lip 533, which allows for the joining of the dynamic wiper to an outer surface of a container.

As shown, the dynamic wiper 531) comprises a scraping element 532 comprising one or more projection (e.g., edges, teeth, or the like) that engage with the applicator element and extend into the interior of a container. When the applicator is removed from the container, such as by pulling or the like, the applicator element passes through the dynamic wiper 530, and any excess product contained thereon is removed by the scraper 532 and maintained inside the container. The dimension and geometry of the scraper element 532 may vary depending on several factors, such as but not limited to, the rheology (i.e., thixotropy, pseudoplastic, or other viscosity regime) of the product and/or the shape and size of application element and/or the orifice.

Figure 6:
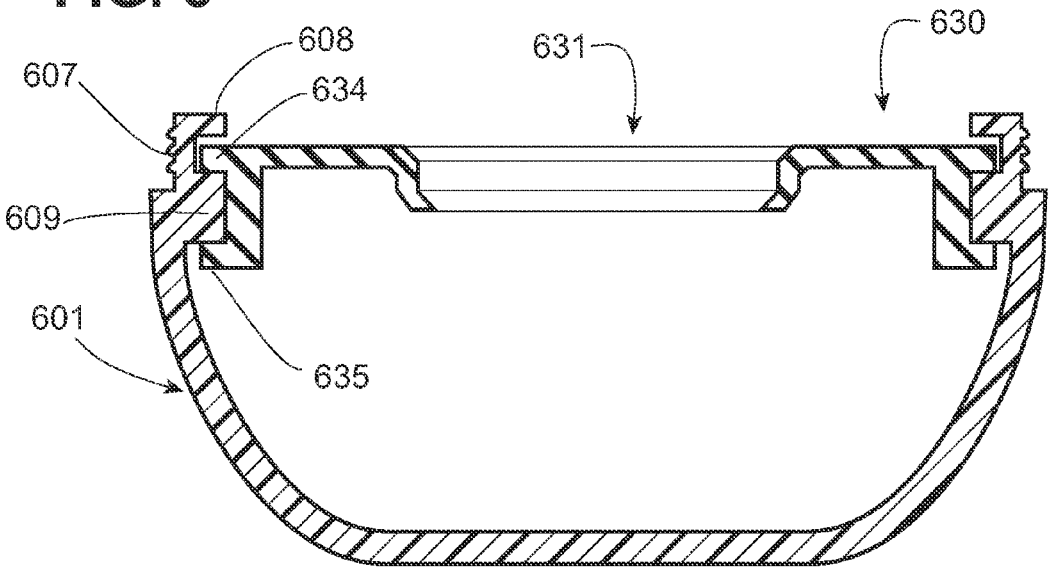
FIG. 6 is a cross-sectional view of an exemplary package having a dynamic wiper 630 disposed within a container 601.

Referring to FIG. 6, an alternative embodiment of a package is shown comprising a container 601 having a dynamic wiper 630, which is partially or fully disposed therein, rather than positioned on a top surface of the container. FIG. 6 illustrates an alternative means for retention of the wiper 630 to the container 601. The container 601 is shown to comprise a threaded area 607 on its outer walls, which mates with the complementary threading of a cap (not shown).

The dynamic wiper 630 is shown to comprise an upper lip 634 and a lower lip 635, which both extend out from the body of the wiper into the interior of the container 601 and towards the side walls thereof. Typically, the upper lip 634 will extend along a top surface of the body of the dynamic wiper 630, although part of the body of the wiper may extend above the top lip or even above the top surface of the container. The lower lip 635 typically extends along the lower surface of the body of the wiper 630, but a portion of the wiper body may extend below the lower lip. Although the upper lip 634 and lower lip 635 will typically be continuous structures (e.g., rims, ledges, or disks), each may alternatively comprise two or more discrete protrusions extending from the body of the wiper.

The container 601 is shown to comprise an optional upper flange 608 and a lower flange 609 that both extend from the inner walls of the container into the interior thereof. The lower flange 609 is housed entirely within the interior of the container 601, and acts to restrain the wiper 630 to movement within a fixed vertical distance. For example, the wiper 630 is restricted from moving toward the base of the container by the tower flange 609 of the container, which engages or catches the upper lip 634 of the wiper when a downward force is exerted on the wiper. The wiper is also restricted from unrestrained movement in a vertical direction toward the opening of the container by the lower flange 609 of the container, which engages or catches the lower tip 635 of the wiper.

In certain embodiments, the upper flange 608 (if included) of the container 601 restricts the dynamic wiper 630 from completely exiting the container. The upper flange 608 may engage with, restrict, or restrain the upper lip 634 of the wiper when an upward force is exerted on the wiper. The outer edge of the upper flange 609 typically defines the outer surface of the container 601, although the entire outer edge may be within the interior of the container.

Both the lower flange 609 and upper flange 608 are typically continuous structures (e.g., annular disks, rims, etc.), but either may alternatively comprise two or more discrete protrusions extending from the inner wall of the container. The lower flange 609 and upper flange 608 of the container will typically extend a distance into the interior of the container which is greater than the radius (or length) of the upper lip 634 and/or lower lip 635 of the wiper.

It will be appreciated that the dynamic wiper 630 is constrained by the upper and lower lips (634, 635) in such a way as to allow for the free rotation of the wiper relative to the container. Moreover, to the extent that the vertical movement of the wiper 630 is described as being "restricted" or "restrained," it will be appreciated that the wiper 630 is typically not completely prevented from moving a fixed distance in an upward and/or downward direction. The amount of vertical movement will generally depend on the height and material of the lower flange 609 and/or the upper flange 608, as well as the distance between the upper lip 634 and lower lip 635 of the wiper. Although the upper and lower flanges (608, 609) typically comprise a rigid materials, one or both may be made from a flexible material to allow for greater vertical movement of the wiper 630. In an alternative embodiment the surface of the wiper 630, including the orifice 631, may be disposed below the plane of the upper lip 634 (i.e., coplanar with the lower lip 635) and the interior side wall of the wiper 630 may then be threaded in lieu of threads 607. In this embodiment, the cap has exteriorly positioned threads that engage the threads on the inside wall of the wiper 630.

During production of the package, the dynamic wiper 630 may be inserted into the container 601 such that the upper lip 634 of the wiper rests on the lower flange 609 of the container. Once the wiper 630 is in place, the upper flange 608 may be attached to the container 601 in any conventional manner. In another embodiment, the upper flange 608 may be molded into the container.

Figure 7:
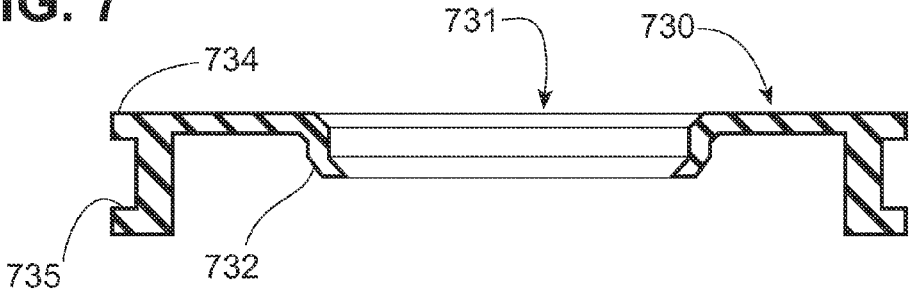
FIG. 7 is a cross-sectional view of an exemplary dynamic wiper 730 on a plane through an orifice 731 of the wiper.

Referring to FIG. 7, a cross-sectional view of a dynamic wiper 730 (such as the dynamic wiper 630 shown in FIG. 6) is shown as taken across a plane intersecting an orifice 731. As shown, the dynamic wiper 730 comprises an upper lip 734 and a lower lip 735 having an orifice 731 running therethrough. The wiper 730 comprises a scraping element 732 comprising one or more protrusions (e.g., edges, teeth, or the like) that engage with an applicator element and extend into the interior of the container. When an applicator is removed from the container, such as by pulling or the like, the applicator element passes through the dynamic wiper 730, and any excess product contained thereon is removed and maintained inside the container. The dimension and geometry of the scraper element 732 may vary depending on several factors, such as but not limited to, the rheology (i.e., the thixotropy, pseudoplastic, or other viscosity regime) of the product and/or the shape and size of application element and/or the orifice.

Figure 8A:
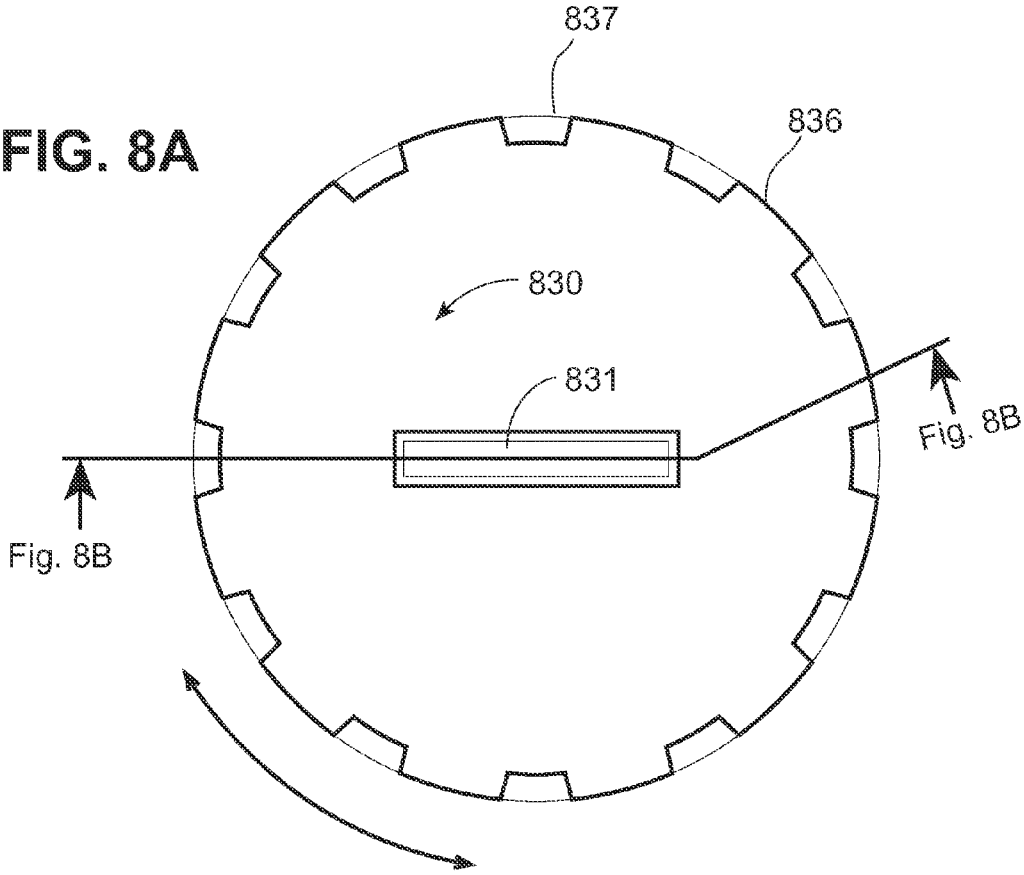
FIGS. 8A and 8B illustrate a top view and side view of an exemplary dynamic wiper, respectively.

Referring to FIG. 8A, a top-view of an exemplary dynamic wiper 830 is illustrated. The wiper 830 comprises a rectangular-shaped orifice 831 located at its geometric center. Although not shown, an applicator may be inserted into the orifice 831 such that the applicator and orifice act to seal a container to which the dynamic wiper 830 is attached. Moreover, the applicator and wiper 830 may be rotated in relation to the container.

As shown, the outer edge of the wiper 830 is defined by one or more cutaway portions ("grooves") 837, which may engage with corresponding projections within a cap FIG. 9 at 915). The grooves 837 are cut into the flat surface of the dynamic wiper 836, and may comprise any shape, such as but not limited to, a triangular, semi-circular, rectangular, or other shape, as long as the grooves are capable of engaging with a corresponding projection within the cap. Moreover, the grooves 837 may be cut to any depth within the body of the wiper 830, however they are not typically cut entirely through to the bottom surface of the wiper so that the wiper may act to seal a container on which it is disposed. In certain embodiments, the grooves 837 may be created during the molding of the wiper 830, or may be added after the molding process by such processes as cutting or routing.

Figure 9A:
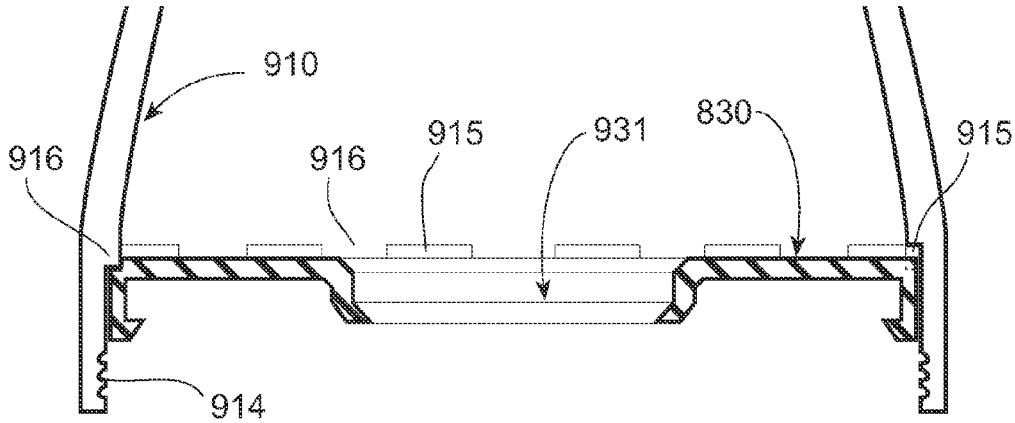
FIGS. 9A and 9B illustrate a cross-sectional and bottom view, respectively, of an exemplary cap 910 that engages with the dynamic wiper 830 of FIGS. 8A and 8B.

In an alternative embodiment, the dynamic wiper 830 may comprise one or more projections (not shown) located at its outer lip, which may engage with corresponding grooves (e.g., FIG. 9A at 916) within the cap (e.g., FIG. 9A at 910). The projections may comprise any shape capable of engaging with a groove within the cap, such as but not limited to, a triangular, semi-circular, rectangular, or other shape. The projections may extend any length in an upward direction from the surface of the wiper 830, as long as a cap can engage with the projections and also attach to a container. In another embodiment, the wiper 830 may comprise both grooves and projections, such as in an alternating pattern.

Figure 8B:
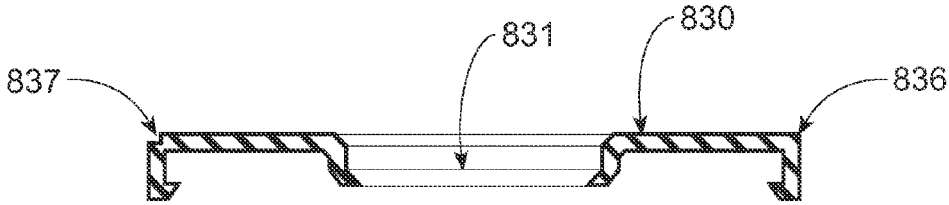

Referring to FIG. 8B, a side view of an exemplary dynamic wiper 830 is shown. The wiper 830 comprises grooves 837 cut into the surface 836 of the outer edge of the wiper. Notably, the grooves 837 are not cut through the entirety of the wiper, such that the wiper, when attached to the top surface of a container, may prevent a product from exiting the container.

Referring to FIG. 9A, a cross-sectional view of an exemplary cap 910 according to the invention is shown. The cap 910 comprises threading 914 such that it may be reversibly screwed onto complementary threading of a container (not shown). The cap may be reversibly attached to the container to prevent an applicator from inadvertently being removed from the wiper or to provide additional sealing.

The interior wall of the cap 910 is shown to comprise a plurality of grooves 916 and projections 915 in an alternating configuration. The grooves 916 of the cap 910 may comprise any shape, but are configured in FIG. 9A to engage or receive the surface 836 of the wiper 830 of FIG. 8A. Similarly, the projections 915 of cap 910 may comprise any shape, but are configured to engage with the grooves 837 of the wiper 830 of FIG. 8A. Accordingly, as the cap 910 is unscrewed or screwed from the container, the dynamic wiper 830 may be caused to rotate about an axis of the container with the proviso that the dynamic wiper is caused to rotate at least in one direction (i.e., connecting or disconnecting), and preferably in both directions. Notably, the cap 910 will cause the dynamic wiper 830 to create a seal with the mouth of the container when the cap is fully screwed onto the container due to the downward force exerted by the cap on the wiper.

Figure 9B:
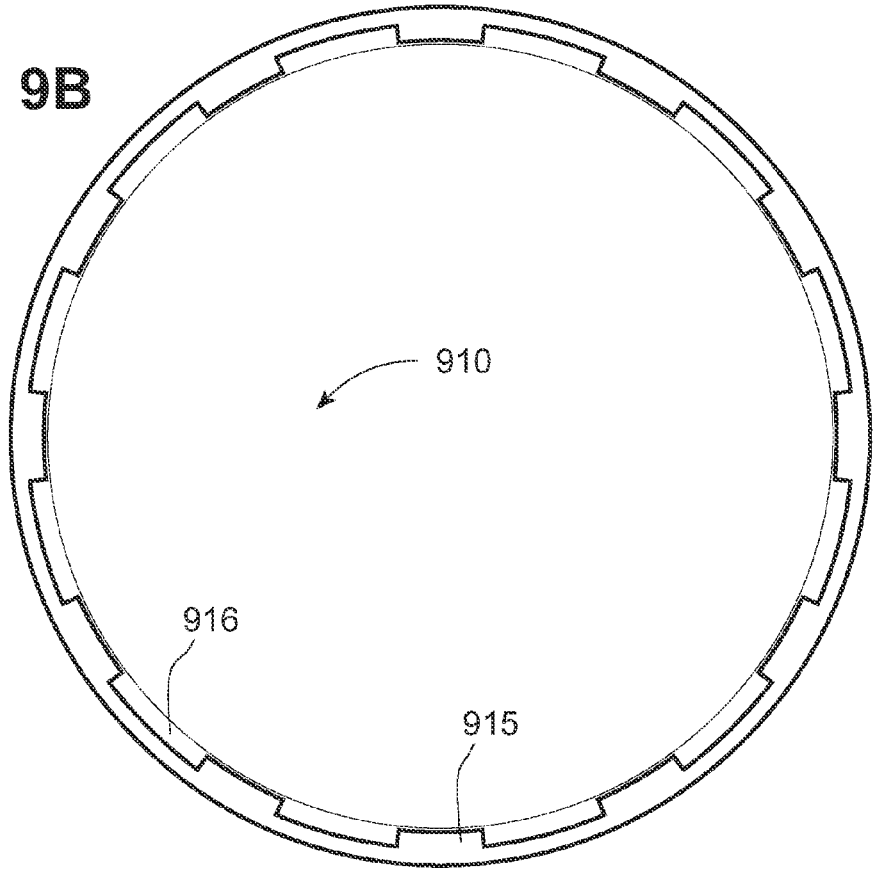

Referring to FIG. 9B, a bottom view of an exemplary cap 910 is shown where the grooves 916 and projections 915 are formed on the interior wall of the cap 910. According to an alternative embodiment, the cap 910 is a stepped cap having a seating portion. The stepped cap design allows the cap 910 to freely spin when seated on the top of a container, absent a downward force.

Figure 10A:
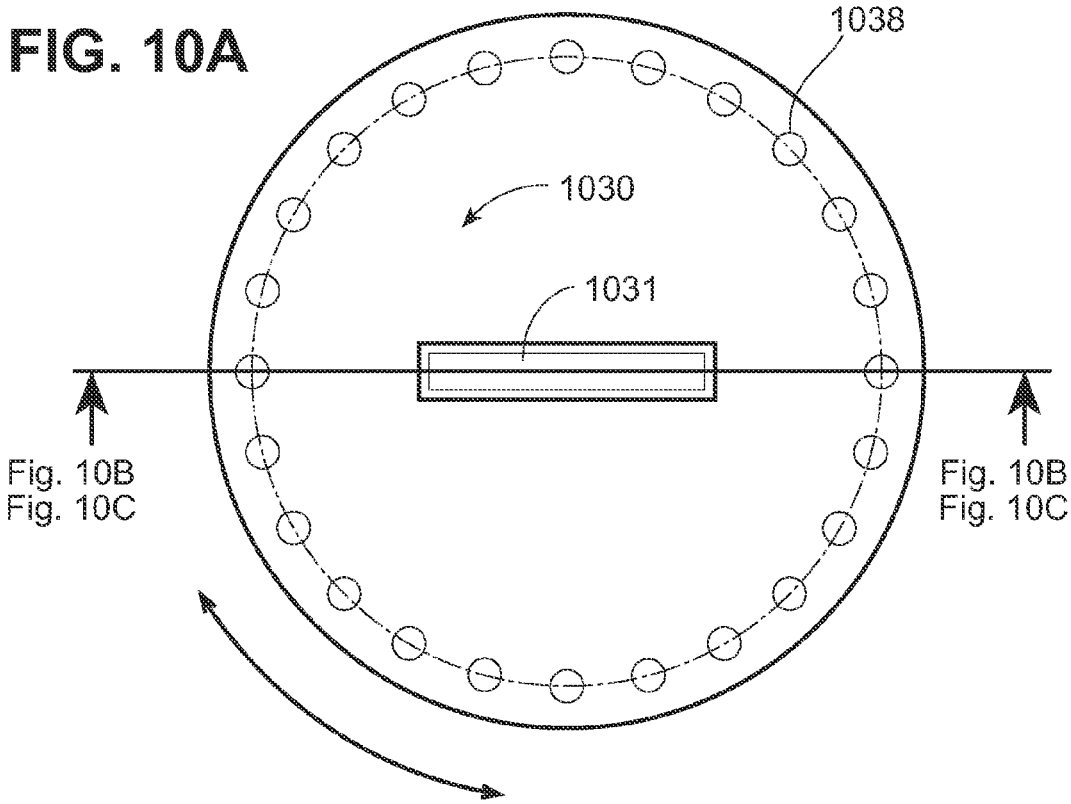
FIGS. 10A, 10B, and 10C illustrate a top view (10A) and side views (10B, 10C) of exemplary dynamic wipers.
Figure 10B:
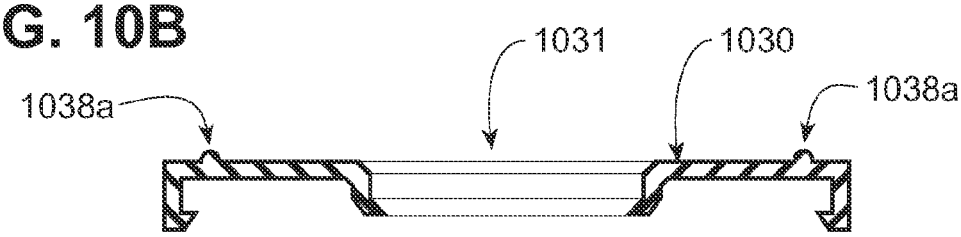
Figure 10C:
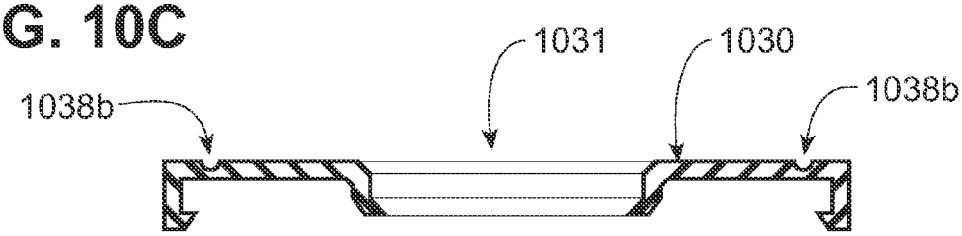

Referring to FIG. 10A, a top-view of an alternative embodiment of a dynamic wiper 1030 is shown. The wiper 1030 comprises an annular disk having a rectangular orifice 1031 therethrough. As shown, the wiper 1030 further comprises a plurality of projections 1038 radially disposed around an inner ring of the wiper. The projections 1038 may extend from the surface of the wiper 1030 in an upward direction to define a raised surface (FIG. 10B at 1038*a*), or may instead extend into the wiper to define an indentation (FIG. 10C at 1038*b*). Moreover, the projections 1038 may comprise any shape, as long as they are adapted to engage with a corresponding projection of a cap (e.g., FIG. 11A at 1115).

Figure 11A:
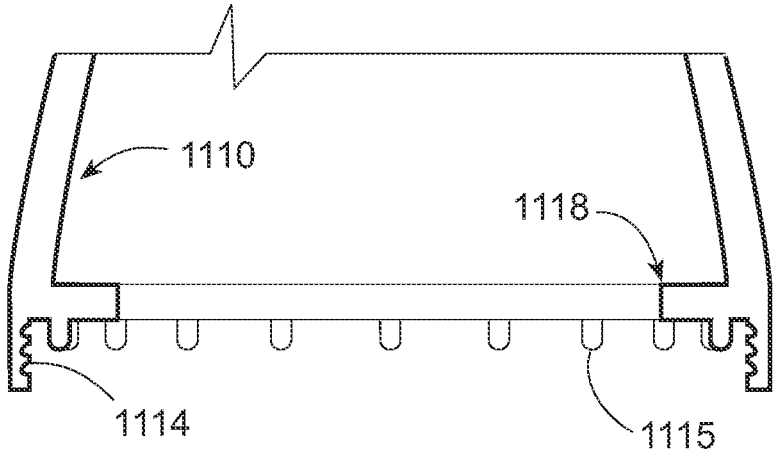
FIGS. 11A and 11B illustrate a cross-sectional and bottom view, respectively, of an exemplary cap 1110 that engages with the dynamic wiper of FIG. 10A.

Referring to FIG. 11A, a cross-sectional view of an exemplary cap 1110 according to the invention is shown. The cap 1110 comprises threading 1114 such that it may be reversibly screwed onto complementary threading of a container (not shown), over an applicator seated within a wiper and the container.

The interior of the cap 1110 is shown to comprise a plurality of projections 1115 located on an inner flange 1118 of the cap. The inner flange 1118 extends from the interior walls of the cap 1110 a distance into an interior space thereof. Typically, the inner flange 1118 will comprise a continuous structure (e.g., a tip, disk, etc), however, the inner flange may alternatively be a series of discrete protrusions extending inwardly from the inner wall of the cap. In any event, the projections 1115 may be dispersed on the bottom surface of the inner flange 1118.

The projections 1115 may comprise either a raised structure or an indentation of any shape, but are configured in FIG. 11A to engage the indentations 1038*b* of the wiper 1030 of FIG. 10C. Accordingly, as the cap 1110 is screwed onto a container, the dynamic wiper 1030 may be caused to rotate about an axis of the container, with the proviso that the dynamic wiper is caused to rotate at least in one direction (i.e., connecting or disconnecting), and preferably in both directions.

Figure 11B:
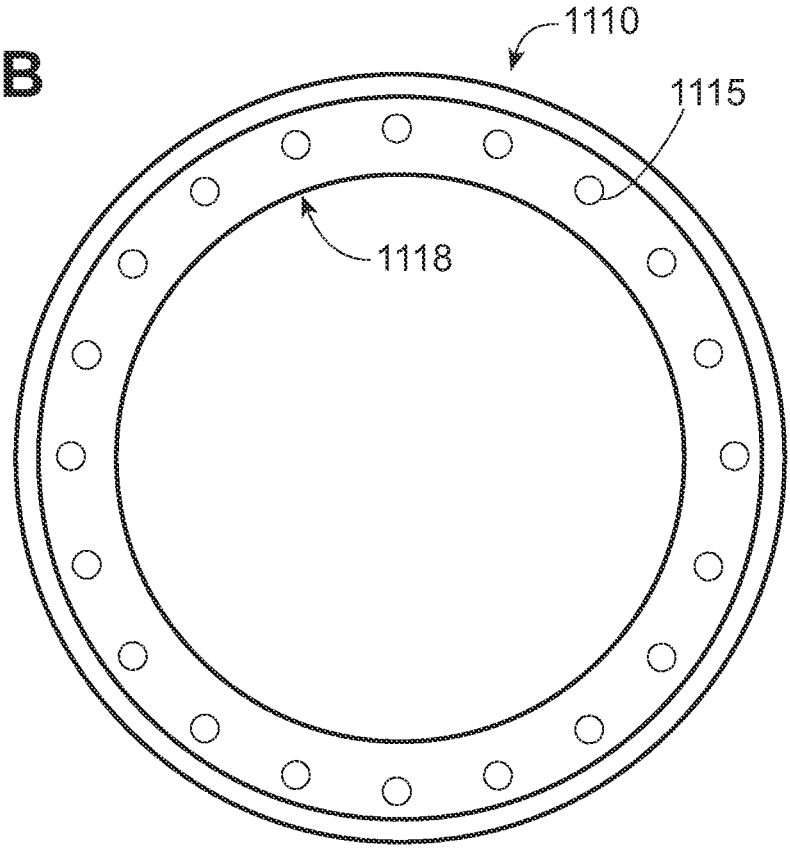

Referring to FIG. 11B, a bottom view of an exemplary cap 1110 is illustrated. As shown, the projections 1115 are formed on an inner flange 1118 of the cap 1110, which extends a distance into the interior space of the cap.

Figure 12:
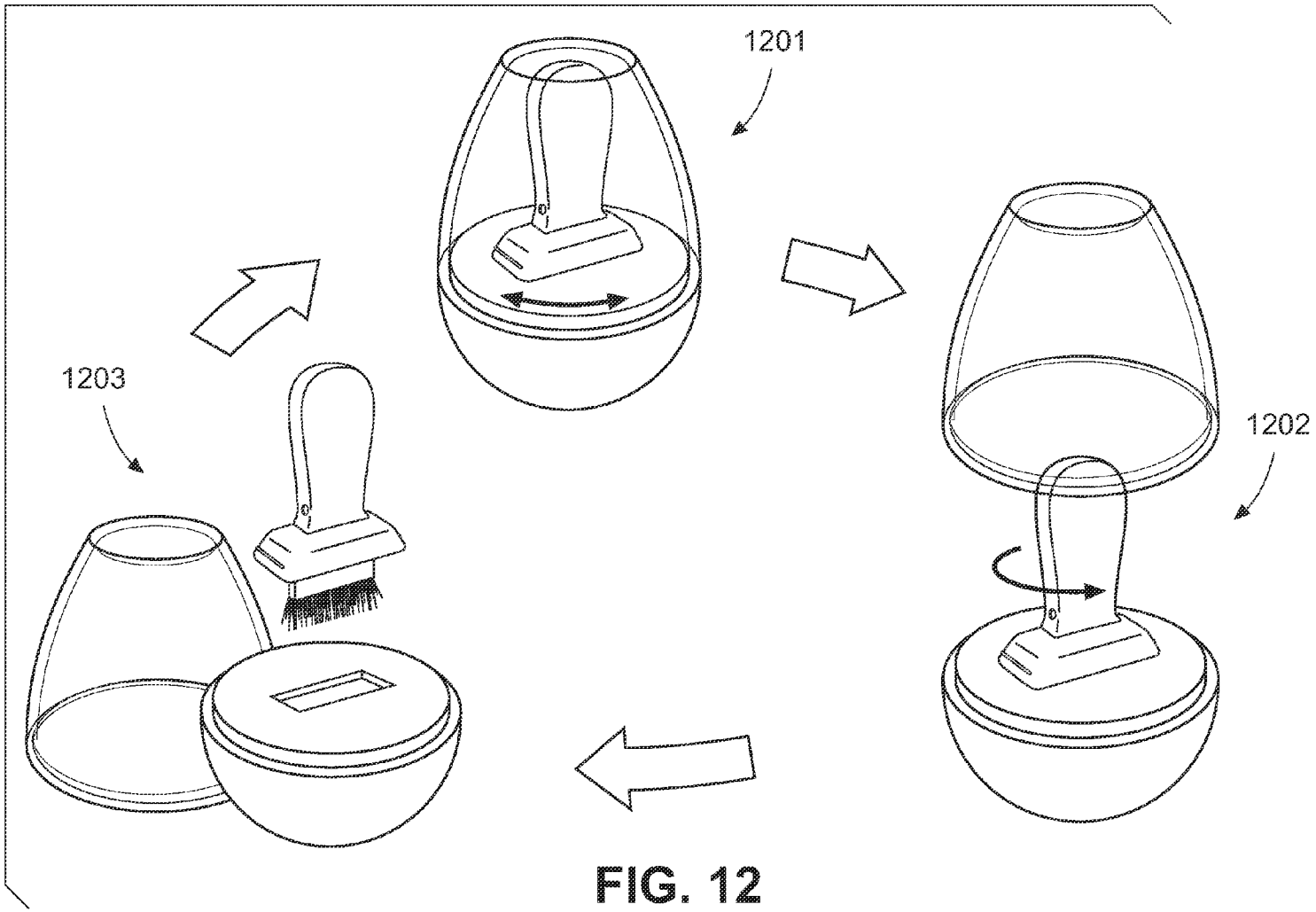
FIG. 12 is a process diagram for the application of a product, according to an exemplary embodiment.

FIG. 12 is a process diagram illustrating an exemplary method for utilizing the packages of the invention. At 1201, the package is shown in a closed state, wherein the cap is attached to the container.

At 1202, a user removes the cap by, for example, unscrewing it from the container or pulling it off of the container. As discussed in detail above, the rotation of the cap causes the dynamic wiper and the applicator housed therein to rotate with respect to the container.

When the cap is separated from the container, the applicator and wiper are still free to rotate. Accordingly, a user may rotate the applicator within the wiper by spinning the handle of applicator, while holding the container steady, or by turning the wiper while holding the container steady. Moreover, if the dynamic wiper comprises a flexible or telescoping material, the user may also move the applicator horizontally, vertically, and/or diagonally in addition to rotating the wiper. Importantly, the applicator may be manipulated white seated within the orifice of the dynamic wiper and without slipping between the applicator and the wiper, allowing for manipulation of the applicator without splashing or spilling of the product. The rotating applicator element disposed within the container (not shown) stirs the product within the container to facilitates its removal therefrom.

At 1203, the applicator is removed from the container, and the scraper element (not shown) of the wiper acts to remove excessive product from the applicator element. A user may then apply the applicator to an appropriate area to coat the surface thereof with the product. In the case of mascara, a charged applicator element may be used to apply the mascara to a user's eye lashes.

Once the application of the product is complete, the applicator may be reinserted into the container through the wiper, and the cap may be re-applied to the container. If the cap comprises screw threads, the screwing of the cap onto the container will cause the dynamic wiper to rotate in the opposite direction than when the cap was unscrewed (i.e., the direction that the cap is turned).

The invention having been described by the forgoing description of the preferred embodiment, it will be understood that the skilled artisan may make modifications and variations of these embodiments without departing from the spirit or scope of the invention as set forth in the following claims.

All patent and non-patent literature discussed above is hereby incorporated by reference in its entirety for all purposes.

We claim:

1. A package for a composition, the package comprising:

(i) a container for holding said composition;

(ii) a wiper having an orifice forming a passage between the exterior and interior of said container, the wiper being capable of rotating with respect to said container;

(iii) an applicator for removing a portion of said composition from said container and transferring it to a surface, the applicator comprising a handle for gripping on one end thereof and an applicator element for holding a charge of said composition on the other end thereof, wherein said applicator is disposed through said wiper orifice such that a portion of the applicator element is brought into contact with said composition and engages with the wiper; said wiper being configured to scrape excess composition from said applicator element when the applicator element is drawn through said wiper orifice upon removing the applicator from the container; and (iv) a cap configured to fit over said applicator when the applicator is engaged with said wiper, wherein the cap is engaged with the wiper such that the wiper is caused to rotate as said cap is rotated about said container, thereby moving the applicator element in a rotational motion in the interior of said container;

wherein a top surface of said wiper comprises a generally annular disk defining an orifice therethrough and having a plurality of grooves and/or projections radially disposed around the circumference of said disk, and wherein said cap includes, on the interior thereof, a plurality of projections and/or grooves complementary to the grooves and/or projections of said wiper, such that the projections and/or grooves of said cap engage the complementary grooves and/or projections of said disk and rotate the wiper as the cap is unscrewed; and wherein rotation of the wiper permits the applicator element to agitate the composition adhered to the inner walls of the container.

2. A package according to claim 1, wherein the cap comprises threading complementary to threading on said container such that the cap may be reversibly screwed on to the container, and wherein the wiper is caused to rotate as said cap is screwed onto and/or unscrewed from said container.

3. A package according to claim 1, wherein the wiper is disposed on a top surface of said container.

4. A package according to claim 1, wherein the wiper is disposed within an interior space of the container.

5. A package according to claim 1, wherein said applicator and wiper together are capable of rotating about an axis defined by said applicator.

6. A package according to claim 1, wherein said applicator and wiper together are capable of rotating about an axis parallel to an axis defined by said applicator.

7. A package according to claim 1, further comprising a liquid disposed inside said container.

8. A package according to claim 7, wherein said liquid is pseudoplastic.

9. A package according to claim 7, wherein said liquid composition is a mascara.

10. A package according to claim 9, wherein said mascara is pseudoplastic.

11. A package according to claim 1, further comprising a powdered solid disposed inside said container.

12. A package according to claim 11, wherein said powdered solid is an eye shadow.

13. The package of claim 1, wherein the applicator and wiper orifice have complimentary cross-sectional shapes.

14. The package of claim 13, wherein the applicator element has an oblong shaped cross-section and the wiper orifice has a complementary oblong shape.

15. A package for a composition, the package comprising:

(i) a container for holding said composition;

(ii) a wiper having an orifice forming a passage between the exterior and interior of said container, the wiper being capable of rotating with respect to said container;

(iii) an applicator for removing a portion of said composition from said container and transferring it to a surface, the applicator comprising a handle for gripping on one end thereof and an applicator element for holding a charge of said composition on the other end thereof, wherein said applicator is disposed through said wiper orifice such that a portion of the applicator element is brought into contact with said composition and engages with the wiper; said wiper being configured to scrape excess composition from said applicator element when the applicator element is drawn through said wiper orifice upon removing the applicator from the container; and (iv) a cap separable from the applicator and configured to fit over said applicator when the applicator is engaged with said wiper, wherein the cap is adapted to engage the wiper and the container;

wherein the cap is engaged with the wiper such that the wiper is caused to rotate as said cap is rotated about said container, thereby moving the applicator element in a rotational motion in the interior of said container; and wherein rotation of the wiper permits the applicator element to agitate the composition adhered to the inner walls of the container.

* * * * *